US007168098B2

(12) United States Patent
West

(10) Patent No.: US 7,168,098 B2
(45) Date of Patent: Jan. 30, 2007

(54) DISPLAY SYSTEM FOR A GARMENT

(76) Inventor: Michael Akira West, 1121 S. Meyler St., San Pedro, CA (US) 90731

( * ) Notice: Subject to any disclaimer, the term of this patent is extended or adjusted under 35 U.S.C. 154(b) by 0 days.

(21) Appl. No.: 10/679,864

(22) Filed: Oct. 6, 2003

(65) Prior Publication Data

US 2004/0133967 A1 Jul. 15, 2004

Related U.S. Application Data

(63) Continuation-in-part of application No. 10/341,276, filed on Jan. 10, 2003, now abandoned.

(51) Int. Cl.
*A41D 1/02* (2006.01)
*A41D 27/20* (2006.01)

(52) U.S. Cl. ..... 2/93; 2/247; 2/94

(58) Field of Classification Search ..... 2/227, 2/244, 77, 93, 115, 94, 69, 69.5, 108, 90, 2/85–87, 114, 160, 123, 125, 128, 312, 161.4, 2/162, 170, 247, 249, 250, 270
See application file for complete search history.

(56) References Cited

U.S. PATENT DOCUMENTS 1,436,854 A * 11/1922 Brady ..... 40/586
2,103,711 A * 12/1937 Cole ..... 2/160
2,134,425 A * 10/1938 West ..... 2/125
2,226,066 A * 12/1940 Moe ..... 2/270
2,274,510 A * 2/1942 Wohl et al. ..... 2/270
2,421,848 A * 6/1947 Philipps ..... 2/270
2,705,326 A * 4/1955 Lahnstein et al. ..... 2/83
2,730,723 A * 1/1956 Jonsson ..... 2/270
3,193,842 A * 7/1965 Bell ..... 2/94
3,214,771 A * 11/1965 Treiber ..... 2/270
3,337,101 A 8/1967 Tombari
4,266,300 A * 5/1981 Partridge ..... 2/247
4,387,838 A * 6/1983 Jackson ..... 224/170
4,389,801 A * 6/1983 Sharrock et al. ..... 40/775
4,498,200 A * 2/1985 Livingstone ..... 2/247
4,532,656 A * 8/1985 Suzuki ..... 2/247
4,601,066 A * 7/1986 Campbell ..... 2/70
4,602,390 A * 7/1986 Morera et al. ..... 2/251
4,650,219 A * 3/1987 Sigman ..... 283/70
4,761,835 A * 8/1988 Chen ..... 2/160

(Continued)

OTHER PUBLICATIONS http://livedesignonline.com , Product News: a light jacket: FPS mutli-purpose jacket, Jun. 1, 2001, Zero-g Ltd.*

(Continued)

*Primary Examiner*—Alissa Hoey
(74) *Attorney, Agent, or Firm*—Larson Newman Abel Polansky & White, LLP

(57) ABSTRACT

The invention is directed to a garment comprising a first and second sleeves, a flap, and a pocket. The arms of a wearer are fitted through the first and second sleeves. The first and second sleeves have first and second openings, respectively. The flap is provided along the first sleeve and is adapted to be positioned between open and closed positions. The closed position constricts the first opening of the first sleeve. The pocket is disposed between the flap and the first sleeve.

19 Claims, 6 Drawing Sheets

U.S. PATENT DOCUMENTS

| | | | | | |
|---|---|---|---|---|---|
| 5,088,116 | A | | 2/1992 | Gould | |
| 5,105,477 | A | * | 4/1992 | Golde | 2/93 |
| 5,173,968 | A | * | 12/1992 | Fox | 2/244 |
| 5,452,479 | A | * | 9/1995 | Mostert | 2/195.1 |
| 5,477,633 | A | | 12/1995 | Leinberger | |
| 5,669,078 | A | * | 9/1997 | Scremin et al. | 2/247 |
| 5,671,481 | A | * | 9/1997 | Giard | 2/170 |
| 5,704,067 | A | * | 1/1998 | Brady | 2/170 |
| 5,884,338 | A | | 3/1999 | Golde | |
| 5,924,135 | A | * | 7/1999 | Worth | 2/125 |
| 5,933,873 | A | * | 8/1999 | Curran et al. | 2/247 |
| 5,953,758 | A | * | 9/1999 | Foster | 2/268 |
| 6,227,424 | B1 | * | 5/2001 | Roegner | 224/219 |
| 6,233,747 | B1 | * | 5/2001 | Barker | 2/247 |
| 6,374,414 | B1 | * | 4/2002 | Collier | 2/69 |
| 6,769,139 | B1 | * | 8/2004 | Goldkind | 2/247 |
| 2002/0073475 | A1 | * | 6/2002 | Bloom et al. | 2/69 |
| 2003/0154537 | A1 | * | 8/2003 | Carey et al. | 2/160 |
| 2003/0182714 | A1 | * | 10/2003 | Mariland et al. | 2/247 |
| 2004/0211798 | A1 | * | 10/2004 | Schechter | 224/222 |

OTHER PUBLICATIONS http://www.xero-gfilms.com FPS Jacket.*

* cited by examiner

DISPLAY SYSTEM FOR A GARMENT

CROSS-REFERENCE TO RELATED APPLICATION(S)

This is a continuation-in-part application of U.S. patent application Ser. No. 10/341,276 filed on Jan. 10, 2003 now abandoned entitled "DISPLAY SYSTEM FOR GARMENT," the contents of which are expressly incorporated herein by reference in their entirety.

FIELD OF THE DISCLOSURE

The present invention relates generally to a display system and a method of displaying a document, and more particularly, to a garment such as a jacket having a pocket so as to display documents therein.

BACKGROUND OF INVENTION

Documents such as season passes, lift tickets and trail maps are typically carried on an enthusiast's neck, for example, by a skier or snowboarder. In addition, such items are typically carried in a coat or pants' pocket or are disposed in a pocket on a garment worn inside a jacket, for example, a shirt pocket. In order to show the document prior to boarding a lift, for example, the document may be disposed in the enthusiast's shirt pocket and thus the enthusiast may have to remove several articles of clothing to accomplish this task. For example, the enthusiast may have to remove a scarf or neckwarmer to have access to the jacket's zipper. In addition, the enthusiast may find it cumbersome to pull on the zipper with gloves or mittens and may have to remove them to have the dexterity to operate the zipper and reach into a shirt, pants or jacket pocket for the document. As a result, the enthusiast's body and skin may be exposed to inclement weather conditions, such as rain or snow, while attempting to display the pass and subsequently ride the chair lift. Furthermore, the bulkiness of the gloves or mittens may make access cumbersome and even inconvenient when the enthusiast has the season pass disposed in a jacket pocket or pants' pocket, for example.

Pass and/or document holder arrangements, for example, located on a gaiter of a jacket or inside the jacket are used to reduce the problems described above. Such holder arrangements require the jacket or outer garment to be flipped or lifted up in order to make the identification visible. The enthusiast uses at least one hand and possibly both hands to flip or lift up the jacket and make the document visible to the lift operator. While this method addresses the problem of showing documents, such method has drawbacks and is limited. A skier, for example, may place their ski poles aside or angle them in such a way to be able to lift or flip the jacket. When this activity takes place in a chair lift line, the skier may hold up the line while placing materials in hand aside or may cause injury to other skiers standing in line when placing their ski poles at an angle. Furthermore, other enthusiasts may find take offense with the manner the document is displayed. The fact that the jacket has to be lifted or flipped up may not only be offensive to other enthusiasts, but may also be economically harmful to the business.

Accordingly, there is a need in the art for an improved method of displaying a document such as, a season pass, in a jacket garment.

SUMMARY

Aspects of the invention are found in a garment comprising a first and second sleeves, a flap, and a pocket. The arms of a wearer are fitted through the first and second sleeves. The first and second sleeves have first and second openings, respectively. The flap is provided along the first sleeve and is adapted to be positioned between open and closed positions. The closed position constricts the first opening of the first sleeve. The pocket is disposed between the flap and the first sleeve.

Further Aspects of the invention are found in a garment comprising a first and second sleeves, a generally triangular flap and at least one pocket. The arms of a wearer are fitted through the first and second sleeves. The first and second sleeves have respective first and second openings. The generally triangular flap has a side secured to the first sleeve generally parallel to a generally longitudinal axis direction of the first sleeve. A potion generally opposite the side is adapted to be fastened to the first sleeve. The pocket is disposed between the flap and the first sleeve.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
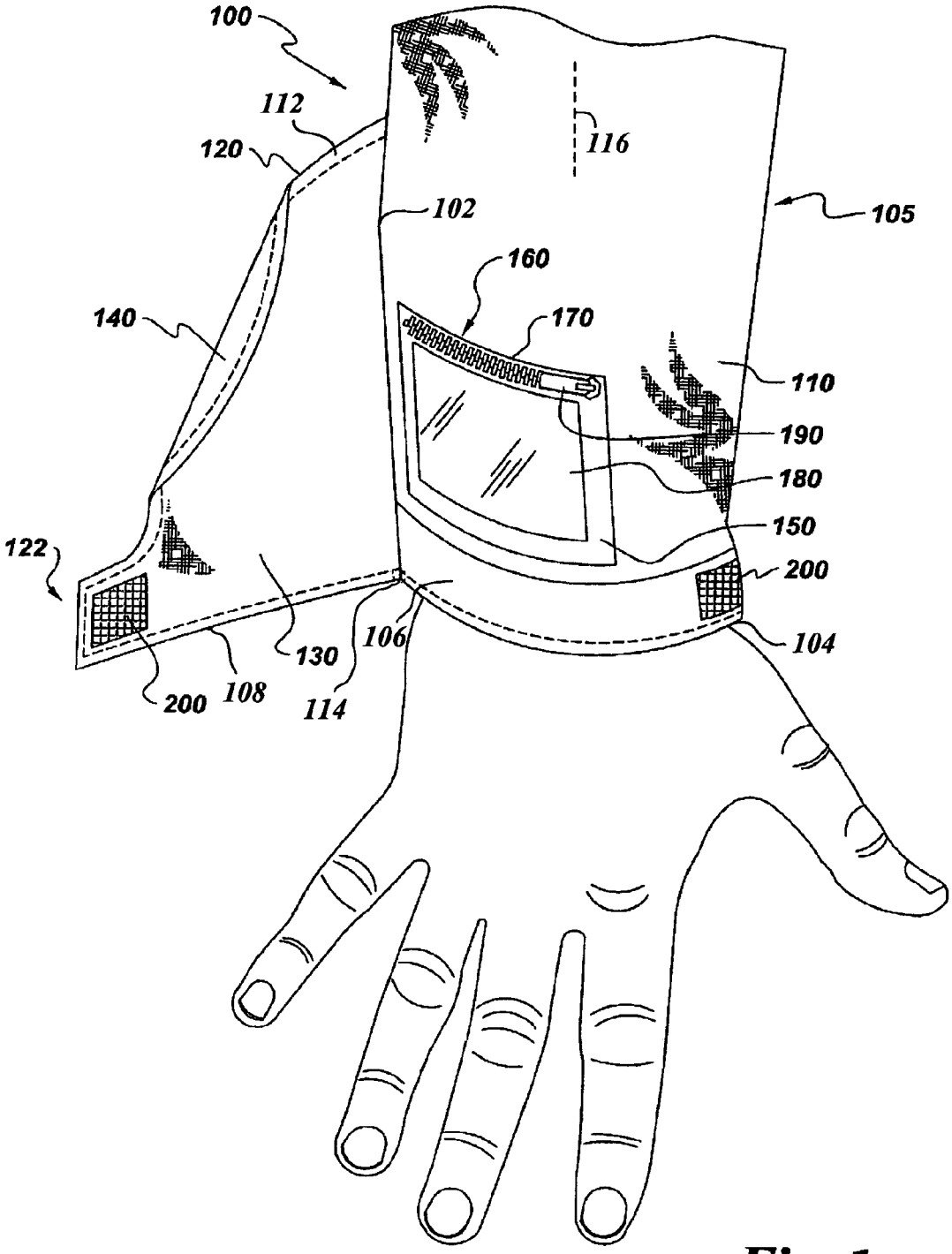
FIG. 1 is a perspective view of a display system in an OPEN position in accordance with one embodiment of the present invention.

Referring now to the drawings. FIG. 1 schematically shows display system 100 comprising a garment 105 (only a portion of which is shown in FIGS. 1–5), having a garment outer surface 110 and a (meaning at least one) flap 120 wherein the flap 120 is secured to the garment 105. The garment 105 and the flap 120 are typically joined by a (meaning at least one) flap fastener 200. The flap fastener 200 comprises, but is not limited to, snaps, zippers, hook and loop materials and the like. In one exemplary embodiment, the flap fastener 200 typically comprises a (meaning at least one) two part hook and loop fastener having a first part secured to the garment 105 and a second part secured to a flap inner surface 130 so as to matingly join the garment 105 and the flap 120. In another exemplary embodiment, the hook and loop fastener typically comprises a loop strip aligned for mating with a hook strip wherein the hook strip is disposed on the garment 105 and the loop strip is disposed on the flap inner surface 130. It will be appreciated that such hook and loop fastener configuration may be reversed and the number of hook and loop fasteners may vary as would be apparent to one skilled in the art.

Figure 3:
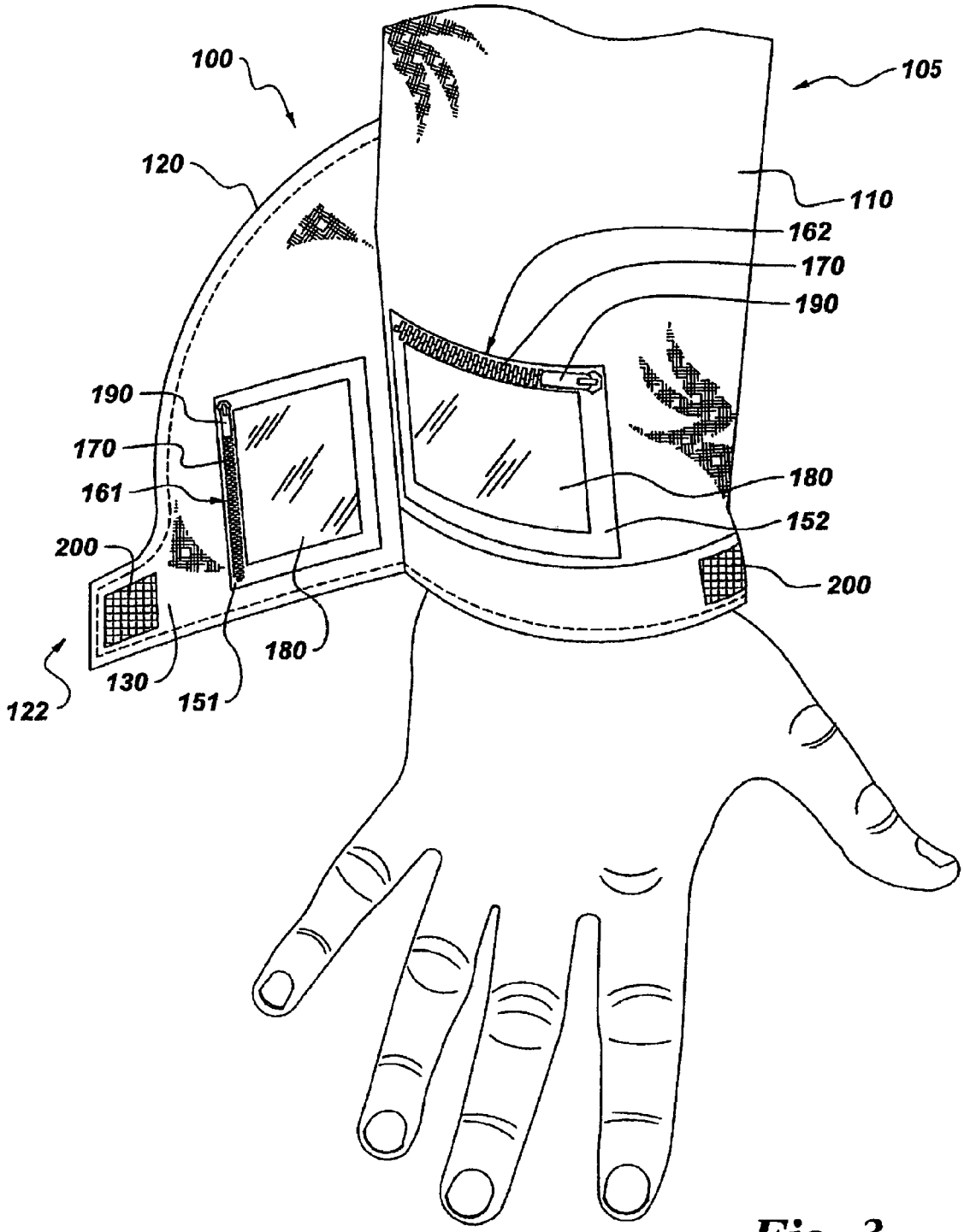
FIG. 3 is a perspective view of the display system in accordance with another embodiment of the present invention.
Figure 4:
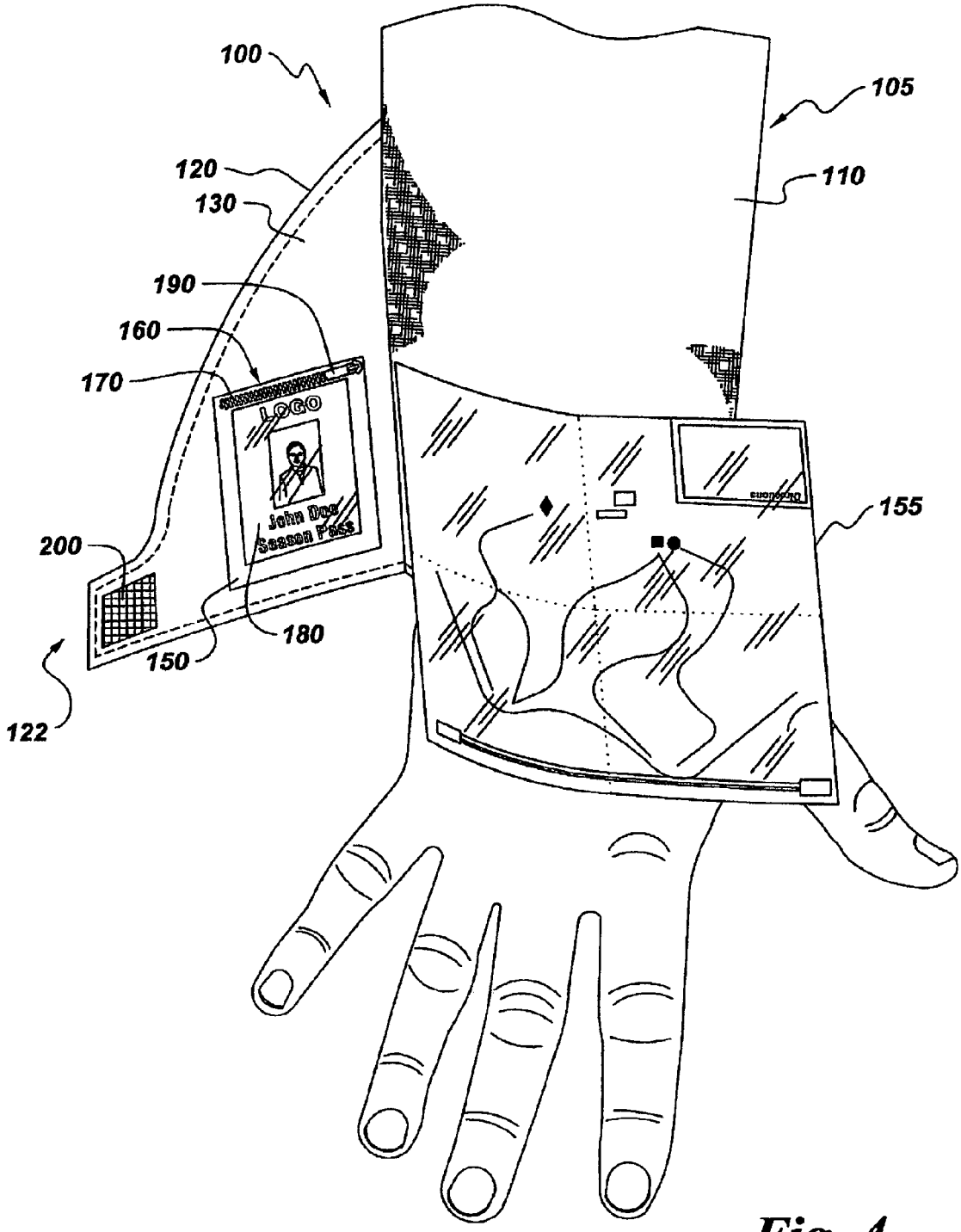
FIG. 4 is a perspective view of the display system in accordance with another embodiment of the present invention.
Figure 5:
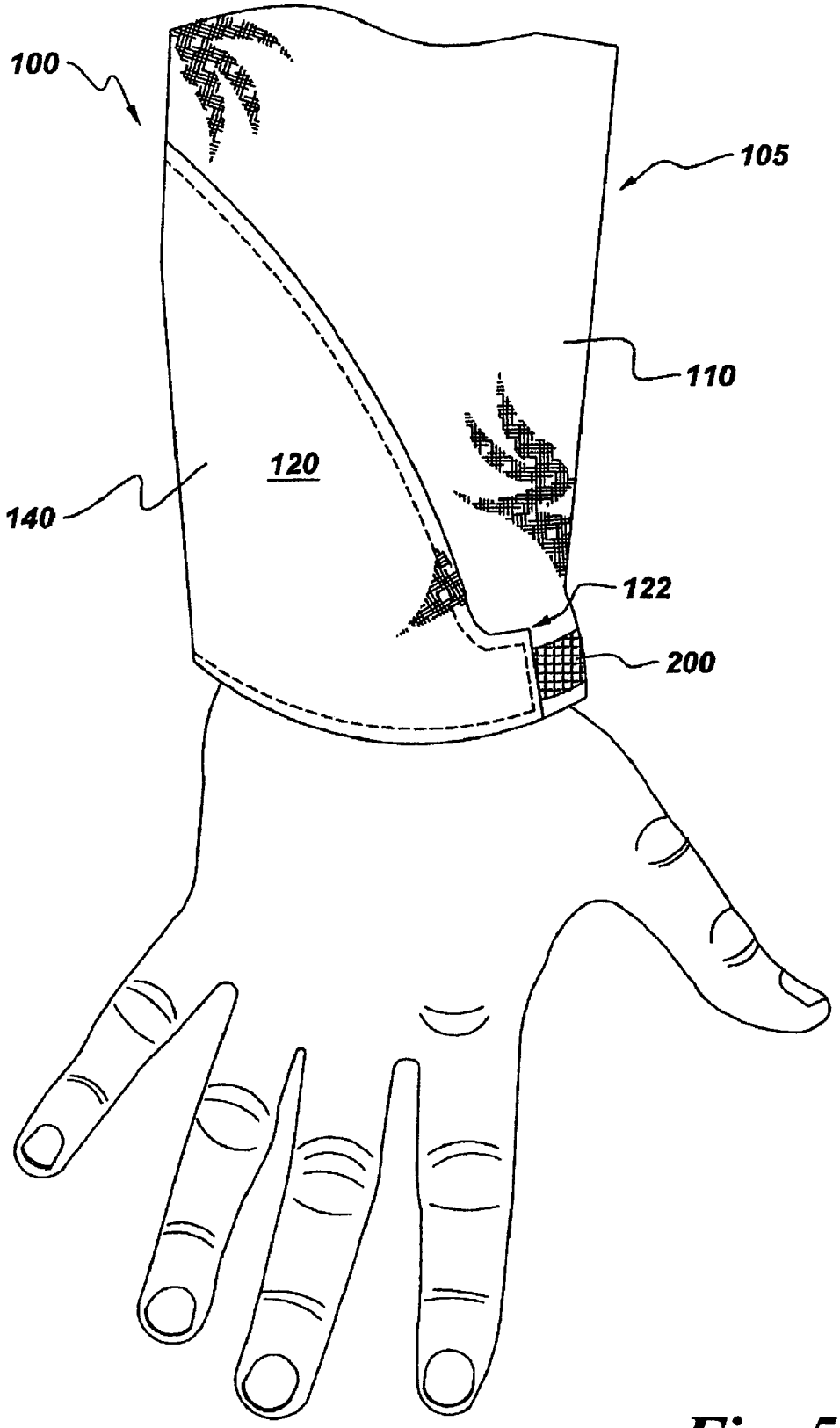
FIG. 5 is a perspective view of the display system of FIGS. 1–4 in a CLOSED position.

The flap 120 comprises the flap inner surface 130, a flap outer surface 140 and a (meaning at least one) pocket 150 disposed between the flap inner surface 130 and the garment outer surface 110. It will be appreciated that the flap 120 is movable between a first OPEN position (as shown in FIGS. 1–4) and a second CLOSED position (as shown in FIG. 5) so as to make contents of the pocket 150 visible. The term "OPEN position", as used herein, refers to the position of the flap 120 wherein a flap end 122 of the flap 120 and the garment outer surface 110 are not in physical contact with each other (see FIG. 1) or when the flap fasteners 200 are not in contact. The term "CLOSED position", as used herein, refers to the position of the flap 120 wherein the flap end 122 and the garment outer surface 110 are in physical contact with each other (see FIG. 5) or when the flap fasteners 200 are in contact. In exemplary embodiments, the shape of the flap 120 comprises square, triangular, rectangular and irregular shapes. In a particular embodiment, the flap has a generally triangular shape with a side coupled to a sleeve approximately parallel to the seam in either a straight or arcuate shape. A second side or edge has a straight shape extending parallel to a cuff. A third side has an arcuate shape.

Figure 6:
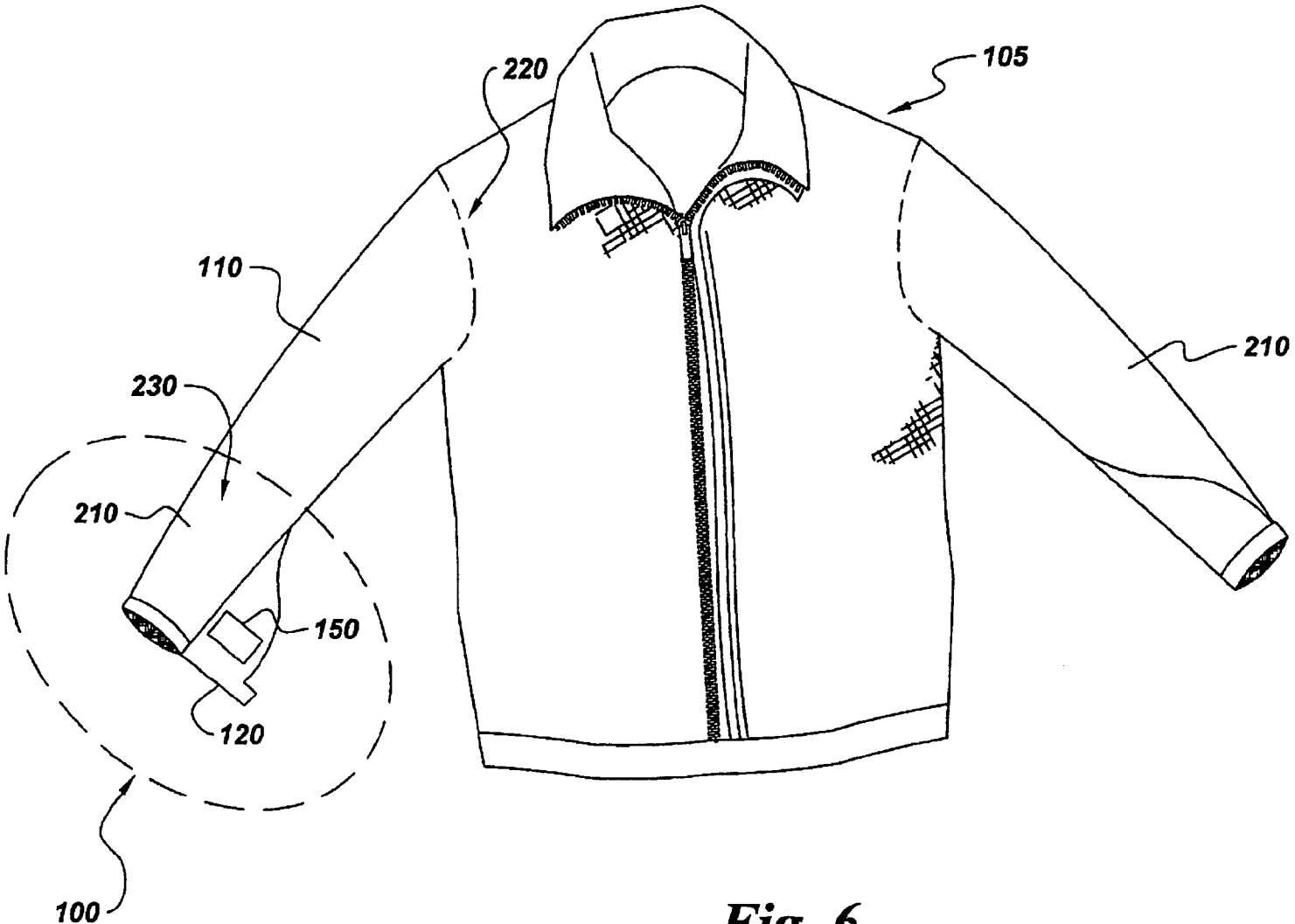
FIG. 6 is a front view of a garment comprising the display system of FIGS. 1–4.

The garment 105 typically comprises jackets, shirts, coats, pants and the like. In one exemplary embodiment, the garment 105 comprises a pair of sleeves 210 wherein at least one flap 120 is secured on at least one of the sleeves 210 and at least one pocket 150 is disposed between the flap 120 and the sleeve 210 (see FIG. 6). It will be appreciated that FIG. 6 shows the sleeves 210 of the garment 105 having a fixed end 220 and a loose end 230. In one exemplary embodiment, the flap 120 is secured proximate the loose end 230 wherein the pocket 150 is disposed between the flap 120 and the sleeve 210.

In a particular embodiment, the garment 105 has a sleeve with an opening 104. The opening is defined by a cuff 106. The flap 120 has a generally triangular shape having three sides. One side is attached to the sleeve in a strait or arcuate fashion generally parallel to a generally longitudinal axial direction 116, such as parallel to a seam or along an arm. A second side 112 of the flap 120 has a arcuate shape leading form the secured side 102 and arcing to a tab or point 122 having fastener 200. A third side 108 extends from the secured side 102 to the corner or tab 122 having the fastener 200. The side or edge 108, when the fastener and flap are in a closed position, runs generally parallel to the cuff 106. In this particular embodiment, the length of side 108 may be shorter than a length along cuff 106 from flap attachment point 114 to the fastener portion 200 attached to the cuff 106. When closed, the flap 120 forces the opening 104 to constrict. In an alternate embodiment, the portion of fastener 200 attached to the cuff 106 may have multiple fastening points or may be an extended fastener portion such as an extended portion of a hook-and-loop fastener system. The flap 120 may be closed and the fastener 200 attached to the flap 120 selectively positioned to provide more or less constriction of opening 104.

In other exemplary embodiments, the flap 120 may take other shapes such as square, triangular, rectangular, and irregular shapes. The flap 120 may be configured to constrict opening 104 using alternate mechanisms such as draw strings, adjustable flap sizing systems, adjustable systems for manipulating the length of tap 122, and adjustable systems for manipulating a portion of the cuff 106. For example, an adjustable length drawstring or fabric belt may be attached to the outer surface 140 of the flap 120, permitting manipulation of the length of the edge 108 or the extendible perimeter of the flap around the opening 104. In another exemplary embodiment, the tab 122 may provide a belt-and-buckle system to permit extension or contraction of the tab 122. In a third exemplary embodiment, a belt-and-buckle system may be provided between attachment point 114 and fastening point near the fastener 200 along the cuff 106 to manipulate the length along cuff 106.

The pocket 150 (see FIG. 2) is typically sized and shaped to receive contents comprising at least one of the group selected from a card, ticket, trail map, season pass, keys, currency and combinations thereof. The term, "sized and shaped", as used herein, refers to the structure of the pocket 150 in which the pocket 150 is able to receive and store the contents described above. It will be appreciated that such contents are exemplary and that other contents may be received and stored as would be apparent to one skilled in the art. In another exemplary embodiment, as shown in FIG. 4, the pocket 150 is secured to the flap inner surface 130 and an oversized pocket 155 is secured to the garment outer surface 110. For purposes of illustration, FIG. 4 shows the pocket 150 containing a season pass disposed therein and the oversized pocket 155 containing a trail map disposed therein. As used herein, directional words such as, for example, "thereon", "therein", "on", "in", " over" and "under" are used to refer to the relative location of the elements of display system 100 as illustrated in the Figures and are not meant to be limitations in any manner with respect to the orientation or operation of display system 100. In addition, the position, orientation and shape of the pocket 150 and the oversized pocket 155 in the Figures is shown for illustrative purposes and, in one embodiment, such shape, for example, comprises square, triangular, rectangular or irregular shapes. It will be appreciated that all of the elements disclosed herein, including the flap 120, the pocket 150 and the oversized pocket 155, are typically stitched, glued or affixed in position by other fastening means as would be apparent to one skilled in the art.

Figure 2:
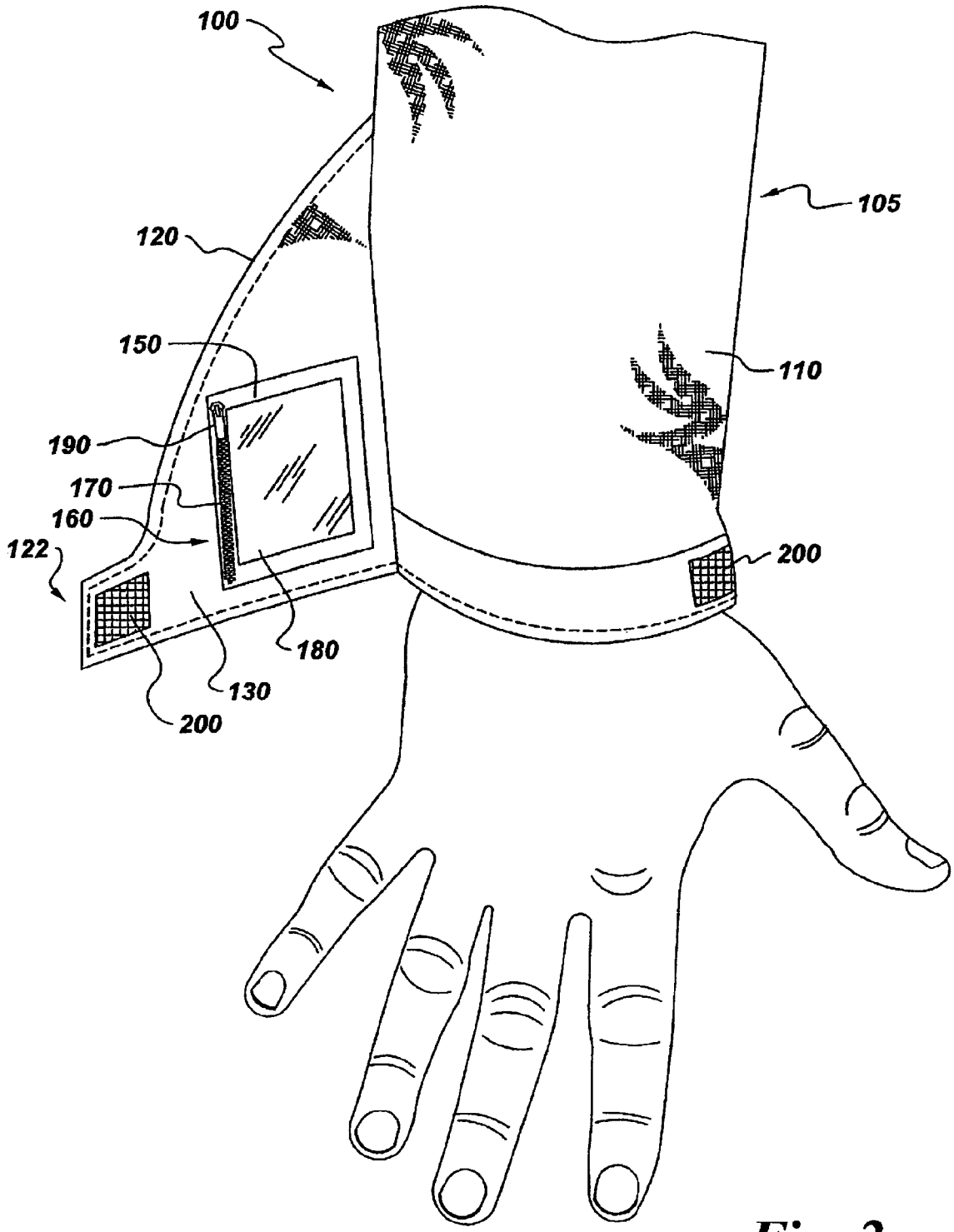
FIG. 2 is a perspective view of the display system in accordance with another embodiment of the present invention.

As shown in FIG. 2, the pocket 150 has an (meaning at least one) opening 160 adapted to receive at least one article comprising a card, ticket, trail map, season pass, keys, currency and the like. However, it will be appreciated that the opening 160 can vary in size and can have a different orientation as shown in the Figures. As such, the number and position of the pocket 150 and the opening 160 can vary and may be different than shown in the Figures. In one exemplary embodiment (as shown in FIG. 3), a first pocket 151 is secured to the flap inner surface 130 and a second pocket 152 is secured to the garment outer surface 110. Here, both pockets 151,152 comprise a first opening 161 and a second opening 162, respectively. The position of such openings 161,162 may be disposed in different areas of pockets 151,152 respectively, and such position is shown for illustrative purposes in the Figures. As shown in FIGS. 1–4, the opening 160, first opening 161 and second opening 162 typically comprise a (meaning at least one) pocket fastener 170 so as to secure the abovementioned contents therein. In addition, the pocket fastener 170 serves to make the pocket 150 weather resistant. In one embodiment, the pocket fastener 170 comprises, but is not limited to, snaps, hook and loop fasteners, zippers, tabs and combinations thereof. In another embodiment, access inside the pocket 150 is facilitated by a (meaning at least one) pulling device 190 in conjunction with the pocket fastener 170. Such pulling device 190 can comprise, but is not limited to, a tab, ring, string and the like. In one exemplary embodiment, the pulling device 190 comprises a nylon webbing tab secured to the pocket fastener 170 for providing access to the pocket 150. In a further exemplary embodiment, the pocket 150 typically comprises a transparent window 180. The term, "transparent", as used herein, refers to the material properties of such window 180 so that contents therein are easily seen or detected.

It will be apparent to those skilled in the art that, while the invention has been illustrated and described herein in accordance with the patent statutes, modification and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A jacket comprising:

a body portion that covers a portion of a wearer's torso;

first and second sleeves through which the arms of the wearer are fitted extending horn the body portion, the first and second sleeves terminating at respective cuffs defining respective first and second openings through which the hands of the wearer extend;

a flap extending from an outer surface of the first sleeve and provided along the first sleeve, the flap being adapted to be positioned between open and closed positions, wherein in the closed position the flap constricts the first opening of the first sleeve; and a pocket attached to the flap and disposed between the flap and the first sleeve such that the pocket is concealed in the closed position of the flap.

2. The jacket of claim 1, wherein the flap has an edge generally parallel to the cuff, the edge being shorter than a length along the cuff from a point at which the flap originates from the first sleeve to a fastening point.

3. The jacket of claim 1, further comprising a fastener for maintaining the flap in the closed position.

4. The jacket of claim 3, wherein the fastener may be engaged at various fastening points to adjust a degree of constriction of the first opening.

5. The jacket of claim 3, wherein the fastener has first and second portions respectively attached to the flap and the first sleeve.

6. The jacket of claim 3, wherein the fastener is selected from the group consisting of snaps, hook and loop fasteners, zippers, tabs, and combinations thereof.

7. The jacket of claim 3, wherein the fastener is a hook and loop fastener.

8. The jacket of claim 1, wherein the pocket is substantially covered by the flap.

9. The jacket of claim 1, wherein the jacket is a winter sports jacket.

10. The jacket of claim 1, further comprising a second pocket.

11. The jacket of claim 10, wherein the second pocket is disposed between the flap and the first sleeve.

12. The jacket of claim 1, wherein the pocket is sized and shaped to receive at least one of the group selected from a card, ticket, trail map, season pass, keys, currency and combinations thereof.

13. The jacket of claim 12, wherein the pocket is size and shaped to receive a season pass.

14. The jacket of claim 1, wherein the pocket has an opening and wherein the opening includes at least one pocket fastener, the pocket fastener selected from the group consisting of snaps, hook and loop fasteners, zippers, tabs and combinations thereof.

15. The jacket of claim 1, wherein the pocket comprises a transparent window.

16. A jacket comprising:

a body portion that covers a portion of a wearer's torso;

first and second sleeves through which the arms of the wearer are fitted extending from the body portion, the first and second sleeves having respective first and second openings;

a generally triangular flap having a side secured to an outer surface of said first sleeve generally parallel to a generally longitudinal axial direction of said first sleeve, a portion generally opposite said side being adapted to be fastened to said first sleeve of the flap; and at least one pocket attached to said flap and disposed between said flap and said first sleeve such that the pocket is concealed in the closed position of the flap.

17. The jacket of claim 16, wherein said first opening is constricted when said portion of the generally triangular flap opposite said side is fastened to said first sleeve.

18. The jacket of claim 16, wherein said first opening is defined by a cuff of the first sleeve, said generally triangular flap having an unsecured edge extending generally parallel to said cuff.

19. The jacket of claim 16, wherein said generally triangular flap has a second side unsecured to said first sleeve, said second side having a generally arcuate edge.

* * * * *

UNITED STATES PATENT AND TRADEMARK OFFICE

CERTIFICATE OF CORRECTION

PATENT NO. : 7,168,098 B2
APPLICATION NO. : 10/679864
DATED : January 30, 2007
INVENTOR(S) : Michael Akira West It is certified that error appears in the above-identified patent and that said Letters Patent is hereby corrected as shown below:

Claim 1, Column 5, line 19, delete “horn” and insert therefor --from--.

Signed and Sealed this

Twenty-seventh Day of November, 2007

JON W. DUDAS
*Director of the United States Patent and Trademark Office*